United States Patent [19]

Slowe et al.

[11] 4,121,373

[45] Oct. 24, 1978

[54] SOUNDING MECHANISM FOR TOY ANIMALS

[75] Inventors: James E. Slowe, South Wales; Norman A. Wrigglesworth, Williamsville, both of N.Y.

[73] Assignee: The Quaker Oats Company, Chicago, Ill.

[21] Appl. No.: 765,446

[22] Filed: Feb. 4, 1977

[51] Int. Cl.[2] ..... A63H 5/00

[52] U.S. Cl. ..... 46/180; 46/117

[58] Field of Search ..... 46/117, 172, 175 R, 46/178, 180

[56] References Cited

U.S. PATENT DOCUMENTS

| | | | |
|---|---|---|---|
| 2,668,393 | 2/1954 | Rekettye | 46/180 |
| 2,687,888 | 8/1954 | Frampton | 46/180 |
| 3,093,928 | 6/1963 | Ostrander | 46/117 |

*Primary Examiner*—Russell R. Kinsey

*Assistant Examiner*—Robert F. Cutting

*Attorney, Agent, or Firm*—Cumpston & Shaw

[57] ABSTRACT

A sounding mechanism for a toy animal for producing a continuous animal sound of varying tonal quality such as the whinny of a horse. The sounding mechanism comprises a sound housing having an air inlet chamber, an air outlet resonator chamber and an air passage interconnecting the two chambers. A pair of primary and secondary vibratory reeds are coupled together and mounted in the inlet chamber. The primary reed cooperates with one end of the air passage. Apparatus is provided connected to the air outlet chamber for sucking air through the air inlet chamber, air passage and air outlet chamber in succession for initiating vibration of the primary reed. Vibration of the secondary reed by any known mechanism while the primary reed is vibrating alternately varies the effective length of the primary reed for producing a continuous animal sound of varying tonal quality.

10 Claims, 7 Drawing Figures

SOUNDING MECHANISM FOR TOY ANIMALS

BACKGROUND OF THE INVENTION

1. Field of the Invention

This invention relates generally to sounding mechanisms, and more specifically to an improved sounding mechanism for a toy animal or the like for producing a continuous animal sound of varying tonal quality such as a horse's whinny.

2. Description of the Prior Art

It is known in the prior art to provide a toy cow having a sounding mechanism for producing an authentic and entertaining "moo" sound. An exemplary patent of this type is U.S. Pat. No. 3,792,550. Although such toy cows have been highly successful and entertaining to children, the sound produced thereby is of a substantially constant tonal quality or pitch. While such a sound is entirely satisfactory for "moo" sounds or the like, it is not satisfactory for an animal sound such as the whinny of a horse in which a sound of varying tonal quality is desired.

SUMMARY OF THE INVENTION

In accordance with a preferred embodiment of the invention, an improved sounding mechanism is disclosed for a toy animal or the like for producing a continuous animal sound of varying tonal quality such as the whinny of a horse. The sounding mechanism comprises a housing having an air inlet chamber, an air outlet resonator chamber and an air passage interconnecting the air inlet and outlet chambers. Vibratory reed means comprising vibratory primary and secondary reeds coupled together are mounted in the inlet chamber. The primary reed cooperates with one end of the air passage. Means are connected to the air outlet chamber for sucking air through the air inlet chamber, air passage and air outlet chamber in succession for initiating vibration of the primary reed. Means are provided for initiating vibration of the secondary reed simultaneous with the vibration of the primary reed. The vibrating secondary reed alternately varies the effective length of the primary reed for producing a continuous sound of varying tonal quality such as the whinny of a horse.

In a more specific aspect of the invention, the vibratory primary reed has one end secured to the sound housing and its opposite end partially covering one end of the air passage. The vibratory secondary reed has one end secured to the sound housing and its opposite end free.

In another aspect of the invention, the secondary reed is adjacent to and substantially in the same plane as the primary reed, and a flexible link couples the primary reed to the secondary reed.

In a more specific aspect of the invention, the secondary reed comprises a pair of reed elements substantially in the plane of the primary reed and joined together at the free ends of the reed elements. The reed elements are positioned with one reed element adjacent each side of the primary reed. A flexible link couples each of the reed elements to the primary reed. One end of each of the reed elements is integral with the mounting end of the primary reed which is secured to the sound housing. A weight is secured to the joined free ends of the reed elements to facilitate setting the secondary reed into vibratory motion.

The invention and its advantages will become more apparent from the detailed description of the preferred embodiment presented below.

BRIEF DESCRIPTION OF THE DRAWING

In the detailed description of the preferred embodiment of the invention presented below, reference is made to the accompanying drawing, in which.

DESCRIPTION OF THE PREFERRED EMBODIMENT

Figure 1:
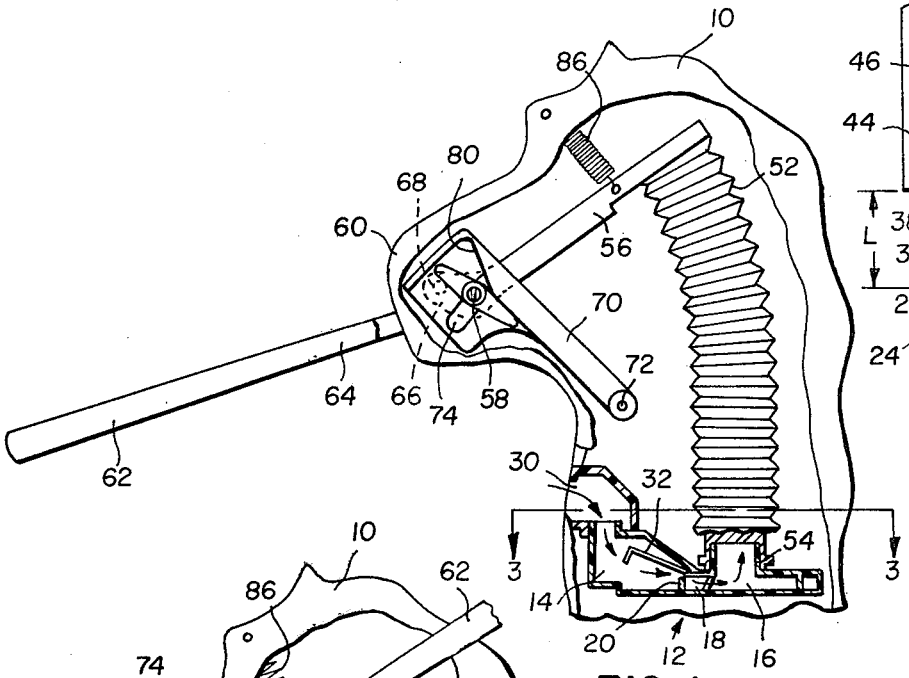
FIG. 1 is a side elevational view of the head of a horse with portions thereof broken away to show a preferred embodiment of the sounding mechanism of this invention.
Figure 4:
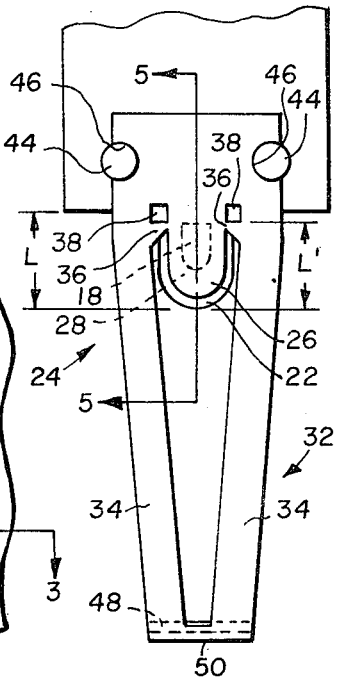
FIG. 4 is an enlarged top plan view of the primary and secondary reeds.
Figure 2:
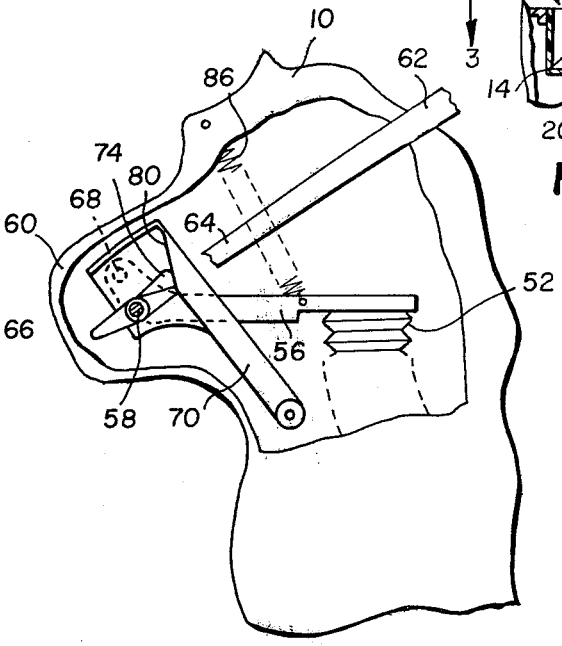
FIG. 2 is a side elevational view similar to FIG. 1 illustrating the position of the air sucking mechanism with the bellows depressed.
Figure 3:
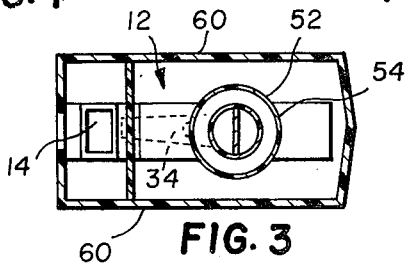
FIG. 3 is a section view taken substantially along line 3—3 of FIG. 1 showing a top plan view of the sound housing.

With reference to FIGS. 1 and 2, a housing 10 in the form of a head of a toy animal such as a horse is disclosed in which the improved sounding mechanism of this invention is incorporated. The sounding mechanism comprises a sound housing 12 mounted within head housing 10 and preferably formed out of a plastic material. The sound housing 12 has an air inlet chamber 14, an air outlet resonator chamber 16, and an air passage 18 interconnecting the two chambers. Air passage 18 extends through a U-shaped boss 20 having a substantially flat upper face 22 (FIG. 5) at the inlet end of the air passage.

With reference to FIGS. 3–6, vibratory reed means are mounted to extend into air inlet chamber 14. The reed means comprises a unitary member 24 having a primary reed 26 resting on face 22 for substantially closing off air passage 18 between air inlet and outlet chambers 14, 16 respecitively. The free end of primary reed 26 bears against a shallot 28 on face 22 which allows some air flow around the shallot and through air passage 18 when the reed in in its normal position bearing against the shallot. Accordingly, when air is sucked or drawn through an entry port 30 in head housing 10, air inlet chamber 14, air passage 18, and air outlet resonator chamber 16 in succession in the direction of the arrows indicated in FIG. 1 by an air sucking mechanism to be described hereinafter, primary reed 26 is deflected downwardly due to the Bernoulli principle. The natural resilience of primary reed 26 returns the reed to substantially its normal position whereupon the reed is again deflected. These alternating forces acting on primary reed 26 cause it to vibrate to produce a substantially constant tone.

The reed means further includes a secondary vibratory reed 32 comprising a pair of thin elongated reed elements 34 located on opposite sides of primary reed 26. One end of each of the reed elements 34 is integrally connected to primary reed 26 by a flexible link 36 of small width to increase its flexibility. The small width is achieved by a pair of substantially square openings 38 extending through unitary member 24. One end of unitary member 24 is clamped between plastic plates 40, 42 of sound housing 12 and is properly oriented or positioned by a pair of plastic pins 44 on upper plate 40 nesting in complementary notches 46 in unitary member 24. The opposite ends of reed elements 34 are joined forming an integral depending lip 48 to which a weight 50 is secured for increasing the sensitivity of secondary reed 32 to vibration and facilitating setting the secondary reed into vibratory motion. The reed elements 34 are further bent upwardly as indicated in FIGS. 1, 5 and 6 to provide sufficient clearance on each side of secondary reed 32 to allow it to freely vibrate within air inlet chamber 14 without striking the walls of sound housing 12.

Figure 5:
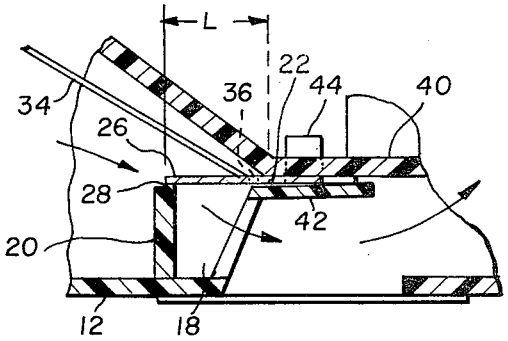
FIG. 5 is a segmental side elevational view in section taken substantially along line 5—5 of FIG. 4 with the secondary reed in the "up" position.
Figure 6:
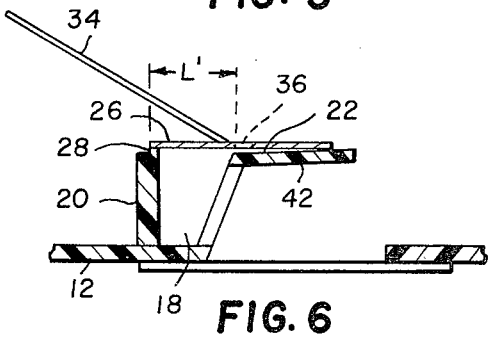
FIG. 6 is a view similar to FIG. 5 showing the secondary reed in the "down" position.

With reference to FIGS. 5 and 6, the reason the reed means produces a sound of varying tonal quality will now be explained. As indicated earlier, air drawn through entry port 30, air inlet chamber 14, air passage 18 and air outlet chamber 16 in the direction of the arrows indicated in FIG. 1 will initiate vibration of primary reed 26. When the secondary reed 32 is set into vibratory motion between up and down positions by means to be described hereinafter, it will in its uppermost position, as illustrated in FIG. 5, cause flexible links 36 to be in a substantially flat or slightly raised condition allowing primary reed 26 to vibrate with an effective length of substantially L for producing a tone of one pitch. When secondary reed 32 is in its lowermost position as illustrated in FIG. 6, flexible links 36 are bent downwardly pressing primary reed 26 against lower plate 42 for shortening the effective length of the primary reed to substantially L′ for producing a tone of a different pitch. Accordingly, as secondary reed 32 vibrates alternately between up and down positions, the effective length of primary reed 26 will be alternately varied producing a sound of varying tonal quality.

Figure 7:
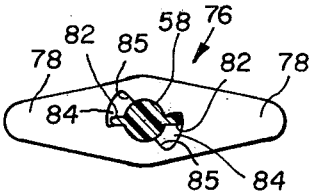
FIG. 7 is an enlarged side elevational view of the cam lever and lost-motion connection of the air sucking mechanism.

With reference to FIGS. 1, 2, and 7, the air sucking mechanism will now be described for drawing air through sound housing 12, and for initiating vibration of secondary reed 32. The mechanism comprises a tube-like, flexible, resilient, accordian type bellows 52, normally extended and having one end secured to an orifice 54 on air outlet chamber 16. The opposite end of bellows 52 is closed and secured to one end of a first lever 56 by any suitable means. The opposite end of lever 56 is pivotally mounted for rotation on a drive shaft 58 journaled for rotation in spaced apart side plates 60 of head housing 10. A U-shaped bridle 62 between which side plates 60 partially extend has free ends 64 thereof secured to opposite ends of drive shaft 58 for rotating the drive shaft upon pivotal movement of bridle 62 between the two positions shown in FIGS. 1 and 2. The end of lever 56 has a radially extending arm 66, the free end of which is pivotally secured by a pin 68 to one end of a second lever 70. The opposite end of lever 70 is pivotally mounted on a support shaft 72 journaled in side plates 60. One end of lever 70 has an elongated slot 74 through which drive shaft 58 extends to allow pivotal movement of lever 70 relative to shaft 58. A cam 76 having oppositely extending fingers 78 is rotatably mounted on drive shaft 58 as best shown in FIG. 7. A lost motion connection is provided between drive shaft 58 and cam 76 which includes drive pins 82 on shaft 58 moveable within arcuate recesses 84 in cam 76. This lost motion allows relative movement between cam 76 and drive shaft 58 for a purpose to be evident hereinafter. Upon rotation of drive shaft 58, drive pins 82 engage shoulders 85 and pivot cam 76 causing one of the fingers 78 to engage a shoulder 80 on lever 70 for pivotally moving the lever.

A spring 86 is interposed between lever 56 and a wall of housing 10 to assist in biasing bellows 52 to its normal extended position as illustrated in FIG. 1 .

In the operation of this invention, when bridle 62 is manually moved clockwise from the FIG. 1 position to the FIG. 2 position, drive shaft 58 drives cam 76 clockwise causing one of the fingers 78 to engage and pivot lever 70. The lever 70, via arm 66 and pin 68 pivots lever 56 depressing bellows 52. This manual movement of the air sucking mechanism is sufficient to initiate vibration of secondary reed 32. A slight further clockwise pivotal movement of bridle 62 from the FIG. 2 position causes cam finger 78 to move over-center relative to shoulder 80. At this point, the compressed bellows 52 and tensioned spring 86 is free to return the bellows and levers 56, 70 to the normal position illustrated in FIG. 1. During such movement the bellows 52 sucks air through sound housing 12 for initiating vibration of primary reed 26 simultaneous with the vibration of secondary reed 32 for producing a continuous animal sound of varying tonal quality. Also, shoulder 80 of lever 70 further pivots cam 76 clockwise through approximately 90° to substantially the FIG. 1 position due to the aforementioned lost motion connection. Return movement of bridle 62 from the latter position to the FIG. 1 position drives cam 76 in the counterclockwise direction for pivoting levers 56, 70 to depress and release bellows 52 in the same manner described heretofore.

The invention has been described in detail with particular reference to a preferred embodiment, but it will be understood that variations and modifications can be effected within the spirit and scope of the invention as described hereinabove.

What is claimed is:

1. A sounding mechanism for a toy animal for producing a continuous animal sound of varying tonal quality such an the whinny of a horse comprising:

a sound housing having an air inlet chamber, an air outlet resonator chamber and an air passage interconnecting said air inlet and air outlet chambers;

vibratory reed means comprising vibratory primary and secondary reeds coupled together and mounted in said inlet chamber and associated with one end of said air passage;

means for initiating vibration of said secondary reed; and means connected to said air outlet chamber for sucking air into said air inlet chamber and through said air passage for initiating vibration of said primary reed simultaneously with the vibration of said secondary reed, said vibrating secondary reed alternately varying the effective length of said vibrating primary reed whereby said sounding mechanism produces a continuous sound of varying tonal quality.

2. The sounding mechanism of claim 1 wherein said vibratory primary reed has one end secured to said sound housing and its opposite free end partially covering said one end of said air passage, and said vibratory secondary reed has one end secured to said sound housing and its opposite end free.

3. The sounding mechanism of claim 2 wherein said secondary reed is adjacent to and substantially in the same plane as said primary reed, and a flexible link couples said primary reed to said secondary reed.

4. The sounding mechanism of claim 2 wherein said secondary reed is adjacent to and substantially in the same plane as said primary reed, a flexible link couples said secondary reed to said primary reed, and a weight is secured to said free end of said secondary reed to facilitate setting the secondary reed into vibratory motion.

5. The sounding mechanism of claim 2 wherein said secondary reed comprises a pair of reed elements substantially in the same plane as said primary reed and joined together at said free ends of said reed elements, said reed elements being positioned with one reed element adjacent each side of said primary reed, a flexible link couples said one end of each of said reed elements to said primary reed, said one of said primary reed and said one end of each of said reed elements are integrally joined together and secured to said housing, and a weight is secured to said joined free ends of said reed elements to facilitate setting the secondary reed into vibratory motion.

6. The sounding mechanism of claim 2 wherein said secondary reed overlies said primary reed and said one end of each of said reeds are secured together.

7. The sounding mechanism of claim 6 wherein said secondary reed has a length substantially three times the length of said primary reed, and a weight is secured to said free end of said secondary reed to facilitate setting the secondary reed into vibratory motion.

8. A vibratory reed for use in a sounding mechanism for toy animals for producing a sound of varying tonal quality comprising:

a vibratory primary reed of one length having a fixed end and a free end extending from said fixed end in one direction; and a vibratory secondary reed longer than said one length and having a mounting end coupled to said fixed end of said primary reed, and a free end extending in said one direction.

9. The vibratory reed of claim 8 wherein said secondary reed is adjacent said primary reed and substantially in the same plane, and a flexible link couples said primary reed to said secondary reed.

10. The vibratory reed of claim 8 wherein said secondary reed comprises a pair of reed elements substantially in the same plane as said primary reed, each of said reed elements having a mounting end and a free end, said reed elements are joined together at said free ends and said mounting ends are positioned adjacent each side of said primary reed, a flexible link for coupling each of said mounting ends of said reed elements to said fixed end of said primary reed, said mounting ends of said reed elements and said fixed end of said primary reed are integrally joined together, and a weight is secured to said joined free ends of said reed elements to facilitate setting the secondary reed into vibratory motion.

* * * * *